US009151507B2

(12) United States Patent
Kil et al.

(10) Patent No.: US 9,151,507 B2
(45) Date of Patent: Oct. 6, 2015

(54) AIR CONDITIONER

(71) Applicant: SAMSUNG ELECTRONICS CO., LTD., Suwon-si, Gyeonggi-do (KR)

(72) Inventors: Yong Hyun Kil, Suwon-si (KR); Jung Ho Kim, Suwon-si (KR); Tae Hun Kim, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 380 days.

(21) Appl. No.: 13/666,312

(22) Filed: Nov. 1, 2012

(65) Prior Publication Data

US 2013/0133351 A1 May 30, 2013

(30) Foreign Application Priority Data

Nov. 24, 2011 (KR) ..... 10-2011-0123431

(51) Int. Cl.
*F25D 21/14* (2006.01)
*F24F 1/02* (2011.01)
*F24F 13/22* (2006.01)

(52) U.S. Cl.
CPC ..... *F24F 1/02* (2013.01); *F24F 13/222* (2013.01); *F24F 2013/225* (2013.01)

(58) Field of Classification Search
CPC . F25D 21/14; F25D 2321/146; F25D 17/065; F25D 17/045
USPC ..... 62/289, 291, 407, 419, 408
See application file for complete search history.

(56) References Cited

U.S. PATENT DOCUMENTS

| | | | | |
|---|---|---|---|---|
| 1,986,863 | A * | 1/1935 | Terry | 62/173 |
| 2,105,108 | A * | 1/1938 | Crosley, Jr. | 62/261 |
| 2,549,547 | A * | 4/1951 | Trask | 62/176.6 |
| 2,970,457 | A * | 2/1961 | MacLeod et al. | 62/279 |
| 2007/0209373 | A1 * | 9/2007 | Taira et al. | 62/78 |
| 2009/0071181 | A1 * | 3/2009 | Spanger | 62/262 |

FOREIGN PATENT DOCUMENTS

| | | |
|---|---|---|
| KR | 10-2003-0000375 | 1/2003 |
| KR | 10-2004-0015880 | 2/2004 |
| KR | 10-2005-0088806 | 9/2005 |
| KR | 10-2005-0106909 | 11/2005 |
| KR | 10-2007-0089004 | 8/2007 |

* cited by examiner

*Primary Examiner* — Melvin Jones
(74) *Attorney, Agent, or Firm* — Stass & Halsey LLP

(57) ABSTRACT

An air conditioner includes a body installed at an outdoor space, and an air discharge tube to guide cold air discharged from the body to an indoor space. An evaporator and a condenser are installed in the body. The evaporator is disposed at a higher level than the condenser. Accordingly, it possible to transfer condensed water generated from the evaporator to the condenser by gravity.

30 Claims, 8 Drawing Sheets

AIR CONDITIONER

CROSS-REFERENCE TO RELATED APPLICATIONS

This application claims the priority benefit of Korean Patent Application No. 10-2011-0123431, filed on Nov. 24, 2011 in the Korean Intellectual Property Office, the disclosure of which is incorporated herein by reference.

BACKGROUND

1. Field

Embodiments disclosed herein relate to an air conditioner in which all constituent elements of a refrigeration cycle are installed within a single body disposed entirely in an outdoor space such that no refrigerant is transferred to an indoor space, and only air generated by the refrigeration cycle is transferred to the indoor space.

2. Description of the Related Art

Generally, an air conditioner may include constituent elements of a refrigeration cycle such as a compressor, a condenser, an expansion device, and an evaporator, to cool or heat an inner space using the constituent elements of the refrigeration cycle.

Air conditioner types may include a separated (sometimes known as a split system) air conditioner and an integrated air conditioner. The separated air conditioner may include an indoor unit installed in an indoor space, and an outdoor unit installed in an outdoor space. The indoor unit of the separated air conditioner may include only some of the constituent elements of a refrigeration cycle (e.g., the evaporator and expansion valve), while the outdoor unit includes the other elements (e.g., the compressor and condenser). An integrated air conditioner may include constituent elements of a refrigeration cycle such as a compressor, a condenser, an expansion device, and evaporator which are installed within a single body.

In the separated air conditioner, which includes an indoor unit and an outdoor unit, as mentioned above, the indoor and outdoor units are connected via a refrigerant tube for transfer of a refrigerant. The refrigerant tube may be lengthened in accordance with the installation positions of the indoor and outdoor units. When the refrigerant tube has a long length, the performance and efficiency of the refrigeration cycle may be degraded.

One example of an integrated air conditioner may be a window air conditioner. In the window air conditioner, which is installed at a window of a building, a portion of a body of the window air conditioner is disposed in an indoor space, and the remaining portion of the body is disposed in an outdoor space. In such a window air conditioner, noise generated from a compressor or other constituent elements, during operation of a refrigeration cycle may be directly transmitted to the indoor space because a portion of the air conditioner is disposed in the indoor space.

SUMMARY

Therefore, it is an aspect of the present invention to provide an air conditioner having all constituent elements of a refrigeration cycle within a single body in an outdoor space, such that the air conditioner is capable of reducing noise transmitted to an indoor space. Additionally, it is an aspect of the present invention for such an air conditioner to more efficiently cool a condenser while having a slim structure.

Additional aspects of the invention will be set forth in part in the description which follows and, in part, will be obvious from the description, or may be learned by practice of the invention.

In accordance with one aspect of the present invention, an air conditioner includes a body installed at an outdoor space, an air discharge tube to guide cold air discharged from the body to an indoor space, a compressor to compress a refrigerant, a condenser to cool the refrigerant discharged from the compressor such that the refrigerant is condensed, an expansion device to expand the condensed refrigerant through pressure reduction, and an evaporator to cause the refrigerant emerging from the expansion device to be evaporated while absorbing heat, wherein the compressor, the condenser, the expansion device, and the evaporator are installed in the body, and wherein the evaporator is disposed in an upper portion of the body at a higher level than the condenser.

Condensed water generated from the evaporator may be transferred from the evaporator to the condenser, and is used to cool the condenser.

The air conditioner may further include a condensed water tray disposed beneath the evaporator, to collect condensed water falling from the evaporator, a water distribution tray disposed over the condenser, and provided with a plurality of water outlets to supply the condensed water to the condenser in a distributed manner, and a water guide tube to guide the condensed water collected in the condensed water tray to the water distribution tray.

The condensed water tray may be disposed at a side of the evaporator to avoid blocking air flowing toward the evaporator. The evaporator may also be inclined toward the condensed water tray so that the condensed water generated by the evaporator is collected into the condensed water tray. The condensed water tray may be inclined toward the water distribution tray.

The body may include a first inlet to suck air to exchange heat with the evaporator, and a first outlet to discharge air to exchange heat with the evaporator. The body may further include a second inlet to suck air to exchange heat with the condenser, and a second outlet to discharge air to exchange heat with the condenser. The air discharge tube may be connected, at one end thereof, to the first outlet.

The air sucked into the body through the first inlet may be transferred to the first outlet after vertically passing through the body. The air sucked into the body through the second inlet may be transferred to the second outlet after vertically passing through the body.

The air sucked into the body through the first inlet and the air sucked into the body through the second inlet may pass through the body in opposite directions, respectively.

The air conditioner may further include an air suction tube connected to the first inlet, to guide air in the indoor space to the body.

The air discharge tube and the air suction tube may be connected, at respective other ends thereof, to a first through hole and a second through hole, which are provided at a wall of a building.

The air conditioner may further include a first blowing fan installed in the body, to cause air to exchange heat with the condenser, and a second blowing fan installed in the body, to cause air to exchange heat with the evaporator.

The air conditioner may further include a drive motor installed in the body, to generate a rotating force. The first blowing fan may be mounted to one end of a rotating shaft of the drive motor, and the second blowing fan may be mounted to the other end of the rotating shaft of the drive motor.

The body may further include a separation wall which separates air which exchanges heat with the evaporator from air which exchanges heat with the condenser. The separation wall may be curved in a direction toward the second inlet to guide the air sucked in through the first inlet such that air is spread across a bottom surface of the evaporator.

The first outlet may be provided at a top wall of the body such that the first outlet corresponds to the evaporator.

The body may be disposed to face, at a rear wall thereof, a wall of a building. The second inlet and the second outlet may be provided at a front wall of the body such that the second inlet and the second outlet are vertically arranged. The condenser may be disposed in a front portion of the body such that the condenser corresponds to the second outlet.

The air conditioner may further include an indoor unit installed in the indoor space, and connected to the discharge guide tube. The indoor unit may include an indoor outlet to discharge cold air into the indoor space.

The air conditioner may further include a guide member installed at the indoor outlet, to guide a flow direction of the cold air discharged through the indoor outlet.

The guide member may be pivotably installed to change the flow direction of the cold air discharged through the indoor outlet.

The indoor unit may further include an auxiliary blowing fan to increase a flow rate of the cold air discharged through the indoor outlet.

In accordance with another aspect of the present invention, an air conditioner includes a body installed in an outdoor space, a condenser installed in the body, to cause a refrigerant to be cooled while exchanging heat with outdoor air, an evaporator installed in an upper portion of the body at a higher level than the condenser, to cause the refrigerant to evaporate while absorbing heat, and to cause condensed water generated at a surface of the evaporator to be transferred to the condenser by gravity, and an air discharge tube to guide, to an indoor space of a building, cold air discharged from the body after passing through the evaporator.

The air conditioner may further include a condensed water tray disposed beneath the evaporator, to collect condensed water falling from the evaporator, a water distribution tray disposed over the condenser, and provided with a plurality of water outlets to supply the condensed water to the condenser in a distributed manner, and a water guide tube to guide the condensed water collected in the condensed water tray to the water distribution tray.

The air conditioner may further include an air suction tube to guide air in the indoor space to the body.

The air conditioner may further include a compressor to compress the refrigerant, and the condenser cools the refrigerant discharged from the compressor such that the refrigerant is condensed, an expansion device to expand the condensed refrigerant through pressure reduction, and the evaporator, which causes the refrigerant emerging from the expansion device to be evaporated while absorbing heat. The compressor, the condenser, the expansion device, and the evaporator are installed in the body.

The air conditioner may further include an indoor unit installed in the indoor space, and connected to the discharge guide tube. The indoor unit may include an indoor outlet to discharge cold air into the indoor space.

In accordance with another aspect of the present invention, an air conditioner includes a body entirely disposed within a space exterior to a building, wherein the body includes a condenser disposed in a lower portion of the body, an evaporator disposed above the condenser in an upper portion of the body, a first fan to draw air external to the body into the body and to direct air circulating within the body toward the evaporator, a second fan to direct air circulating within the body toward the condenser, and a first inlet to draw in air external to the body and a first outlet to discharge air which has passed through the evaporator, out of the body.

The body may further include a compressor, an expansion device to transfer refrigerant between the condenser and the evaporator, and a drive motor to generate a rotating force to the first fan and second fan.

The air conditioner may further include an air discharge tube having a first end connected to the first outlet to receive cold air discharged from the body after passing through the evaporator and a second end through which the cold air is discharged to an interior space within the building, and an air suction tube disposed adjacent to the first fan and having a first end connected to the first inlet and a second end through which air external to the body is drawn into by the rotation force of the first fan.

The second end of the air discharge tube may be connected to an indoor unit disposed in the interior space. The indoor unit may include an indoor outlet to discharge cold air into the interior space, where the indoor unit may be a bellows tube having a first end connected to the air discharge tube and a head mounted to a second end of the bellows tube, or the indoor unit may be a plurality of guide members having a quadrangular pyramid shape to distribute air in a plurality of directions.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
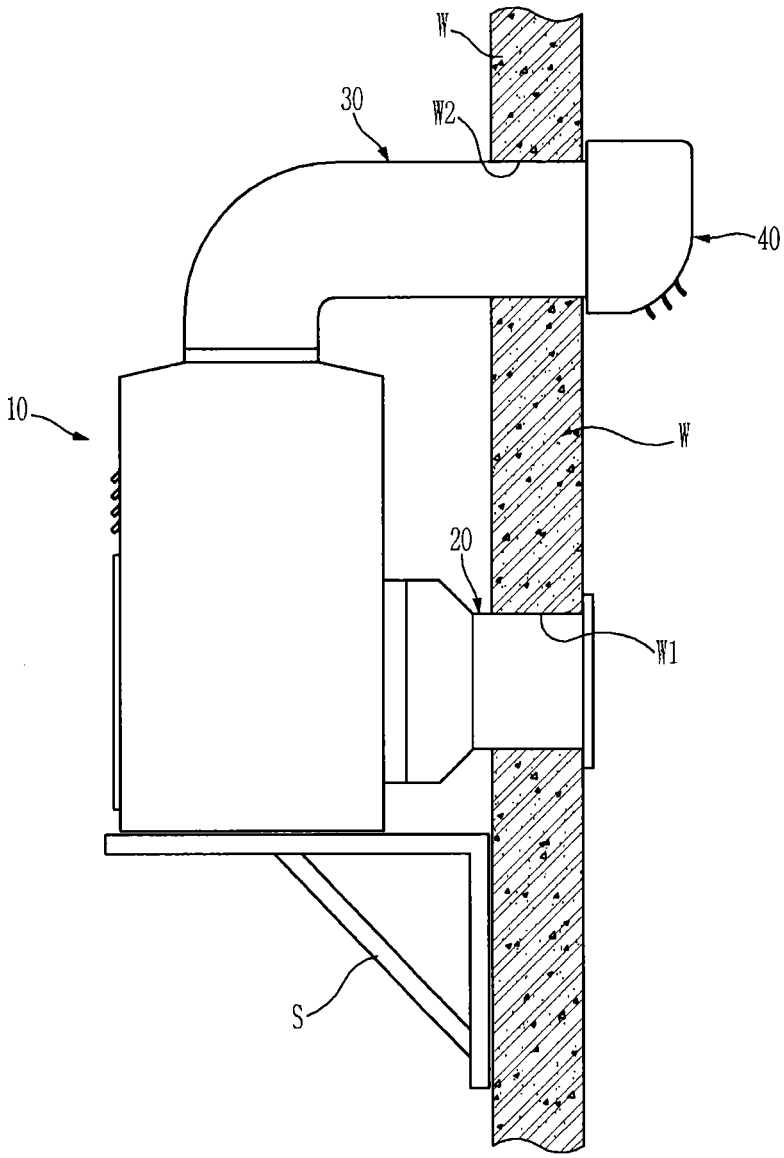
FIG. 1 is a schematic view illustrating an installed state of an air conditioner according to an exemplary embodiment of the present invention.

Hereinafter, an air conditioner according to an exemplary embodiment of the present invention will be described in detail with reference to the accompanying drawings, where like reference numerals refer to like elements throughout.

As shown in FIG. 1, the air conditioner according to the illustrated embodiment of the present invention includes a body 10 disposed in an outdoor space, for example. The body 10 refers to an outer appearance of the air conditioner and may be a structure in which constituent elements of a refrigeration cycle are stored. A suction guide tube 20 and a discharge guide tube 30 are provided at the body 10, to cool indoor air. For example, suction guide tube 20 may be connected to an indoor space at one end through wall W via a first through hole W1, and connected to body 10 at the other end. Discharge guide tube 30 may be connected at one end to indoor unit 40 through wall W via a second through hole W2, to discharge air to an indoor space, and may be connected to body 10 at the other end. Wall W may be, for example, a wall of a building, house, or other like structure. An indoor space may refer to an interior portion of the building, house, or other like structure, while an outdoor space may refer to an exterior portion of the building, house, or other like structure.

Figure 2:
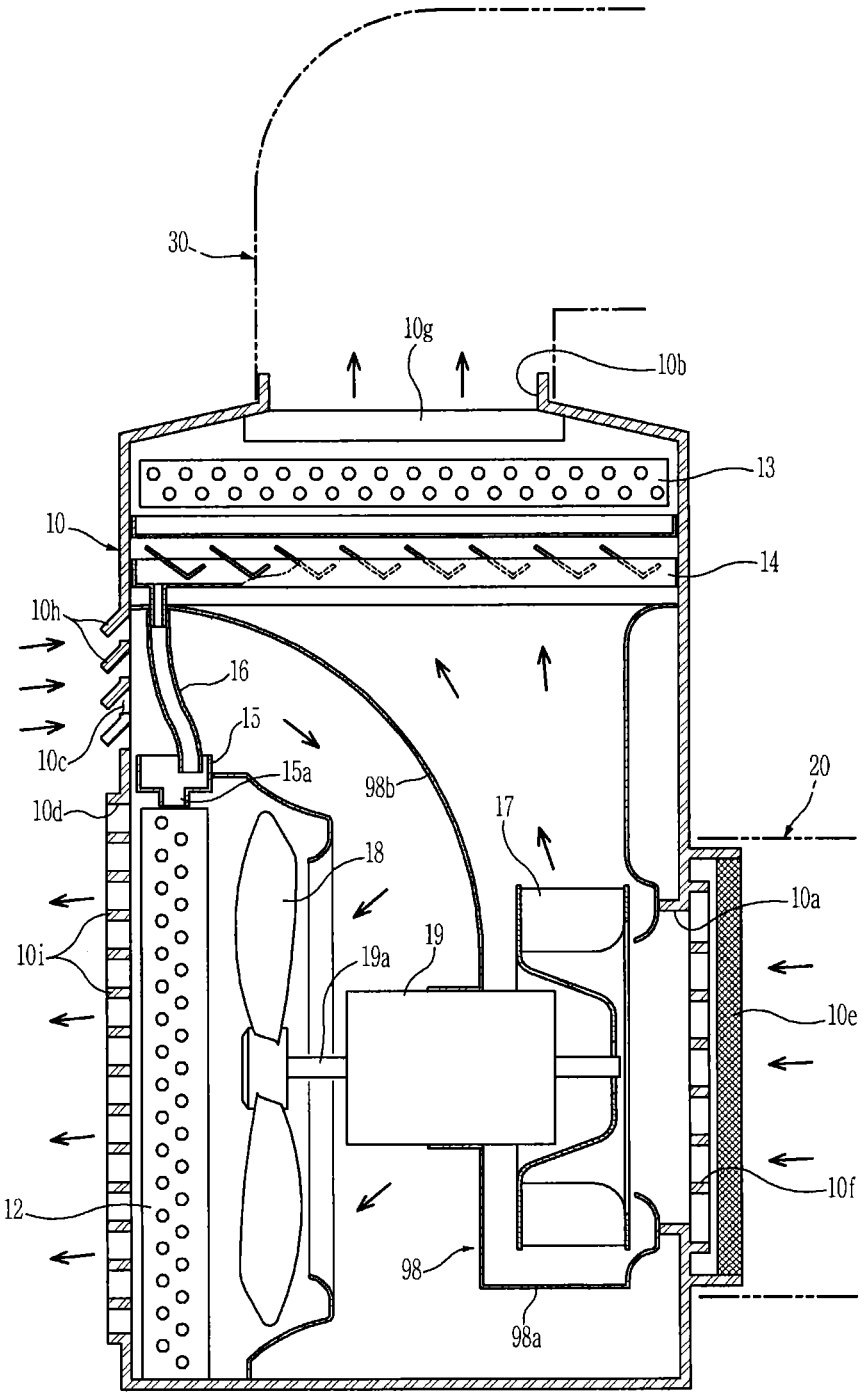
FIG. 2 is a sectional view illustrating the air conditioner according to the illustrated embodiment of the present invention.
Figure 3:
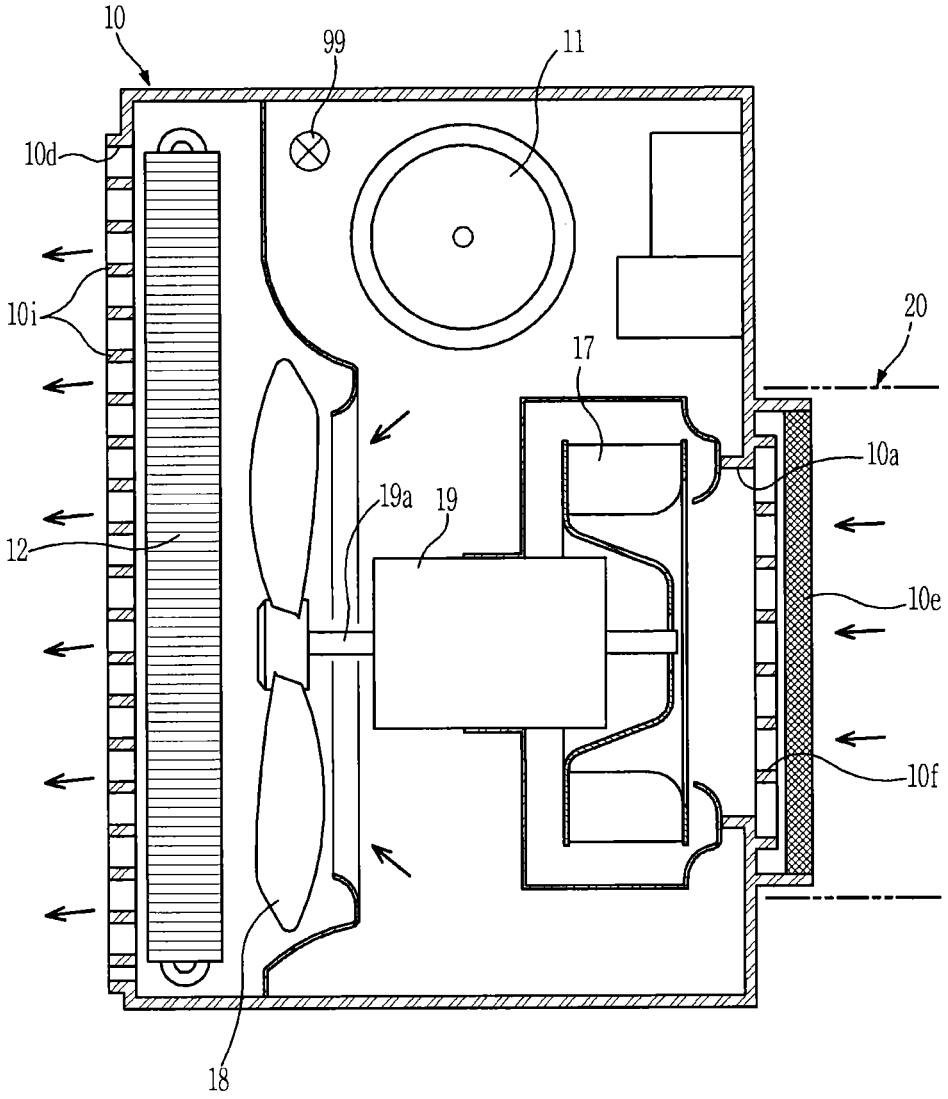
FIG. 3 is a plan view illustrating the air conditioner according to the illustrated embodiment of the present invention.

As shown in FIGS. 2 and 3, constituent elements of a refrigeration cycle to generate cold air are installed within the body 10. That is, constituent elements disposed within the body 10 may include a compressor 11 to compress a refrigerant, a condenser 12 to cool the refrigerant compressed by the compressor 11 such that the refrigerant is condensed, an expansion valve 99 constituted by a capillary tube or the like, to expand the refrigerant condensed by the condenser 12 through pressure reduction, and an evaporator 13 to cause the refrigerant expanded by the expansion valve 99 through pressure reduction to evaporate while absorbing heat. Constituent elements may refer to those elements which are essential components to the refrigeration cycle to perform an air conditioning function. Other components may be included in the body 10 as well which may be desirable, but are not essential, to the performance of the refrigeration cycle. For example, an accumulator (not shown) may be included in the body 10 to collect liquid so that liquid is prevented from entering the compressor 11. A thermostat or temperature sensor (not shown) may be included in the body 10 to monitor a temperature of the refrigerant or an air temperature.

The body 10 may be provided with a first inlet 10*a* to suck air to exchange heat with the evaporator 13, a first outlet 10*b* to discharge air cooled by the refrigerant while exchanging heat with the evaporator 13, a second inlet 10*c* to suck air to exchange heat with the condenser 12, and a second outlet 10*d* to discharge air used to cool the refrigerant while exchanging heat with the condenser 12. The first inlet 10*a* may be provided at a rear wall of the body 10 facing a wall W of a building. The first outlet 10*b* may be provided at a top wall of the body 10. The second inlet 10*c* may be provided at an upper portion of a front wall of the body 10. The second outlet 10*d* may be provided at a relatively lower portion of the front wall of the body 10 than the second inlet 10*c*, such that it may be parallel with the second inlet 10*c*. A filter 10*e* may be installed at the first inlet 10*a*, to separate foreign matter from air passing through the first inlet 10*a*. A lattice-shaped safe net 10*f* may also be installed at the first inlet 10*a*. A silencer 10*g* may be installed at the first outlet 10*b*, to suppress transmission of noise through the first outlet 10*b*. A plurality of louvers 10*h* may be installed at the second inlet 10*c*, to prevent introduction of rainwater. A lattice-shaped discharge grill 10*i* may be installed at the second outlet 10*d*. The body 10 may also be provided with a separation wall 98 which separates the air sucked in through the first inlet 10*a* from the air sucked in through the second inlet 10*c*. The separation wall 98 may be formed in a curved manner such that it smoothly curves in a vertical direction toward the evaporator 13 to guide the air sucked in through the first inlet 10*a* to direct air across the entire bottom surface of the evaporator 13, as well as to guide the air sucked in through the second inlet 10*c* to a rear portion of blowing fan 18. A bottom portion of the separation wall 98*a* may correspond to a bottom portion of the first inlet 10*a*, and the separation wall 98 may begin to curve outward in a direction toward the second inlet 10*c* at point 98*b* which may substantially correspond to an upper portion of the first inlet 10*a*.

When the first inlet 10*a*, first outlet 10*b*, second inlet 10*c*, and second outlet 10*d* are formed as described above, indoor air, which is sucked into the body 10 through the first inlet 10*a*, passes through the body 10 in a direction from the bottom to the top, and then emerges from the body 10 through the first outlet 10*b*. On the other hand, outdoor air, which is sucked into the body 10 through the second inlet 10*c*, passes through the body 10 in an opposite direction to that of the air sucked in through the first inlet 10*a*, namely, in a direction from the top to the bottom, and then emerges from the body 10 through the second outlet 10*d*. That is, the indoor air sucked into the body 10 and the outdoor air sucked into the body 10 are discharged from the body 10 after vertically passing through the body 10 in opposite directions, respectively. Accordingly, it is only necessary to form vertical air passages to guide air. In other words, it is unnecessary to form lateral air passages to guide air. As a result, it may be possible to minimize the lateral width of the body 10, and thus to easily install the body 10 in a space with a narrow lateral width. In this embodiment, the indoor air flow direction is configured to pass through the body 10 in an opposite direction to the outdoor air flow direction. However, the disclosure is not limited to this configuration. That is, the indoor air flow and the outdoor air flow may be configured to pass through the body 10 in the same direction, for example, with the second inlet 10*c* being provided at a lower portion of a front wall of the body 10 and the second outlet 10*d* being provided at an upper portion of a front wall of the body 10. Therefore, in this embodiment air may be drawn upward through second inlet 10*c*.

The evaporator 13 is arranged at the upper portion of the body 10 within the body 10 such that it corresponds to a location of the first outlet 10*b*. That is, the evaporator 13 is above (arranged at a higher level than) the condenser 12 within the confines of the body 10. In accordance with this arrangement, a size (e.g., the width) of the body 10 in a direction from the front to the rear may be minimized, while allowing condensed water generated at the surface of the evaporator 13 to be transferred toward the condenser 12 by gravity. The condenser 12 is arranged at the front side of the body 10 within the body such that it corresponds to the second outlet 10*d*.

In order to allow condensed water generated from the evaporator 13 to be transferred toward the condenser 12 by gravity, as described above, the air conditioner may include a condensed water tray 14 disposed beneath the evaporator 13, to collect condensed water generated from the evaporator 13, a water distribution tray 15 disposed over the condenser 12 and provided with a plurality of water outlets 15*a*, to supply condensed water to the condenser 12 in a distributed manner, and a water guide tube 16 to guide condensed water from the condensed water tray 14 to the water distribution tray 15. Accordingly, condensed water generated from the evaporator 13 is collected in the condensed water tray 14 after falling by gravity, and is then transferred to the water distribution tray 15 via the water guide tube 16. Subsequently, the condensed water is discharged from the water distribution tray 15 to the condenser 12 through the water outlets 15*a*. That is, condensed water generated from the evaporator 13 flows from the evaporator 13 to the condenser 12 by gravity, to be used as cooling water to cool the condenser 12. Accordingly, the cooling efficiency of the air conditioner is enhanced. In one embodiment, the condensed water tray 14 may be provided at one side of the evaporator 13 in order not to block the air flow from the first inlet 10*a* toward the evaporation 13. Additionally, the evaporator 13 may be slightly inclined toward the condensed water tray 14 so that the condensed water generated by the evaporator 13 may be collected into the condensed water tray 14. Here, the condensed water tray 14 may be slightly inclined toward the water distribution tray 15. However, the disclosure is not limited to above described configuration. For example, the condensed water tray 14 may be provided beneath one side of the evaporator 13 along with the water distribution tray 15, and the water guide tube 16 may be comprised of a plurality of water guide tubes arranged along a longitudinal direction of the condensed water tray 14 and the water distribution tray 15.

The suction guide tube 20, which is included in the air conditioner, as described above, is connected, at one end thereof, to the first inlet 10*a* provided at the rear wall of the body 10 while being connected, at the other end thereof, to a first through hole W1 provided at the wall W of the building. The suction guide tube 20 guides indoor air from an indoor space to the interior of the body 10, to allow the air to exchange heat with the evaporator 13. The discharge guide tube 30, which is also included in the air conditioner, as described above, is connected, at one end thereof, to the first outlet 10*a* provided at the top wall of the body 10 while being connected, at the other end thereof, to a second through hole W2 provided at the wall W of the building. The discharge guide tube 30 guides air emerging from the body 10 after exchanging heat with the evaporator 13 such that the air is again introduced into the indoor space.

In order to allow air to exchange heat with the evaporator 13 or condenser 12 while circulating in the body 10, a pair of blowing fans 17 and 18 may be installed in the body 10, to force air to flow in accordance with rotation thereof. Also, a drive motor 19 may be installed in the body 10, to generate a rotating force, and thus to rotate the blowing fans 17 and 18.

The first blowing fan 17 functions to force air to flow such that the air exchanges heat with the evaporator 13 while passing through the body 10. The second blowing fan 18 functions to force air to flow such that the air exchanges heat with the condenser 12 while passing through the body 10. In the illustrated embodiment, the first blowing fan 17 is constituted by a turbo fan to suck air in an axial direction, and then to outwardly discharge the sucked air in a radial direction. For example, air may be sucked in through first inlet 10*a* in a generally horizontal direction, and then discharged toward the discharge guide tube 30 by the first blowing fan 17, in a generally vertically direction. The second blowing fan 18 is constituted by an axial fan to force air to flow in an axial direction.

The drive motor 19 includes a rotating shaft 19*a* protruded from opposite sides of the drive motor 19. The first blowing fan 17 is mounted to one end of the rotating shaft 19*a*, whereas the second blowing fan 18 is mounted to the other end of the rotating shaft 19*a*. Accordingly, simultaneous rotation of the first and second blowing fans 17 and 18 may be performed.

Figure 4:
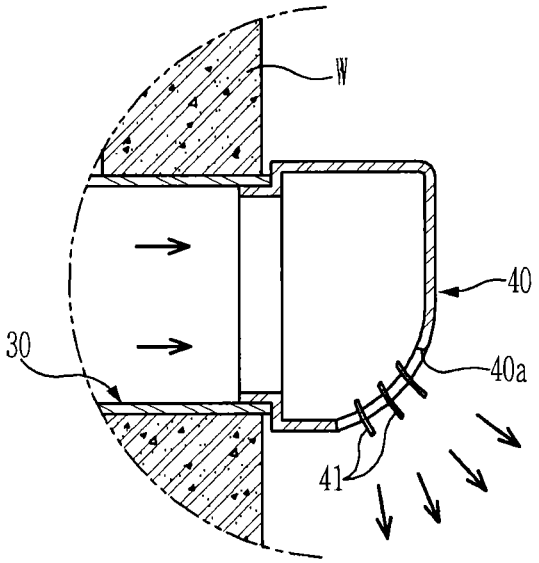
FIG. 4 is a sectional view illustrating an indoor unit applied to the air conditioner according to the illustrated embodiment of the present invention.

An indoor unit 40 may be installed in the indoor space. The indoor unit 40 may be connected to the other end of the discharge guide tube 30, to guide discharge of cold air transferred via the discharge guide tube 30. As shown in FIG. 4, the indoor unit 40 includes an indoor outlet 40*a* to allow cold air to be discharged into the indoor space, and a guide member 41 installed at the indoor outlet 40*a*, to guide cold air discharged from the indoor outlet 40*a* to flow in a particular direction. In the illustrated embodiment, the guide member 41 is installed such that it is vertically pivotable. Accordingly, it may be possible to vertically adjust the discharge direction of cold air, by adjusting the guide member 41. Additionally, the guide member 41 may be adjusted to be closed in the event air conditioning is not being used. The guide member 41 may be adjusted manually or automatically.

When the first and second blowing fans 17 and 18 are rotated in accordance with application of electric power to the drive motor 19, air in the indoor space is guided through the suction guide tube 20 in accordance with rotation of the first blowing fan 17, to be sucked into the body 10 through the first inlet 10*a*. The air is then cooled while passing around the evaporator 13, so that the cooled air becomes cold air. The cold air is guided by the discharge guide tube 30 after emerging from the body 10 through the first outlet 10*b*, to be resupplied to the indoor space, and thus to cool the indoor space.

Also, air in an outdoor space is sucked into the body 10 through the second inlet 10*c* in accordance with rotation of the second blowing fan 18. The sucked air cools the refrigerant of the condenser 12 while passing around the condenser 12, and is then again discharged into the outdoor space through the second outlet 10*d* by rotation force of the second blowing fan 18.

In the above described embodiments, all constituent elements constituting the refrigeration cycle are installed in the body 10, which is disposed entirely in the outdoor space. Air in the indoor space is guided by the suction guide tube 20 into the body 10 and is circulated in the body 10 until air discharged toward the discharge guide tube 30. Therefore, such a configuration suppresses transmission of noise generated from the compressor 11 or other constituent elements or blowing fans 17 and 18 during operation of the air conditioner to the indoor space.

Figure 5:
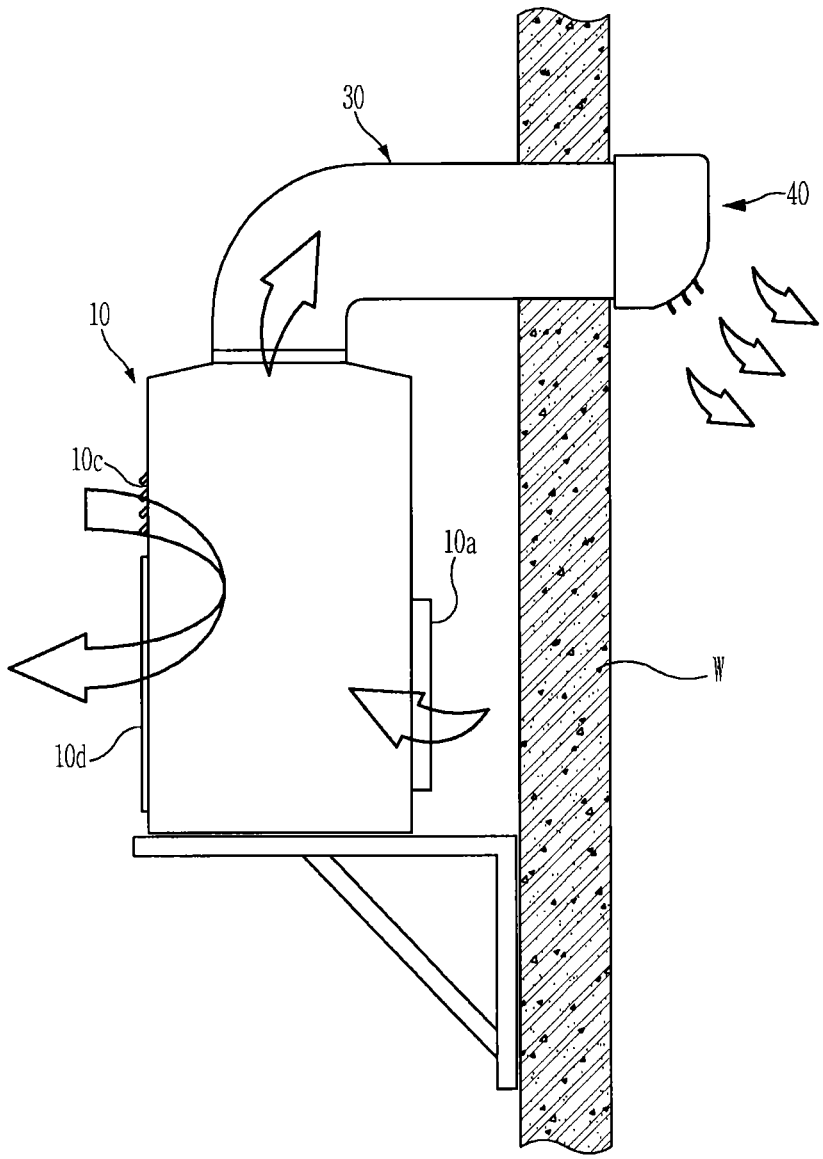
FIG. 5 is a schematic view illustrating an installed state of an air conditioner according to another embodiment of the present invention.

Although the suction guide tube 20 and discharge guide tube 30 are installed in the body 10, to suck air in the indoor space, and to again discharge the sucked air into the indoor space after cooling thereof in the illustrated embodiment, embodiments of the present invention are not limited thereto. As shown in FIG. 5, in one embodiment outdoor air may be sucked through the first inlet 10*a*, and then the sucked air may be discharged into the indoor space in accordance via the discharge guide tube 30 after cooling the air while passing around the evaporator 13. Therefore, the suction guide tube in this embodiment is not necessary.

Figure 6:
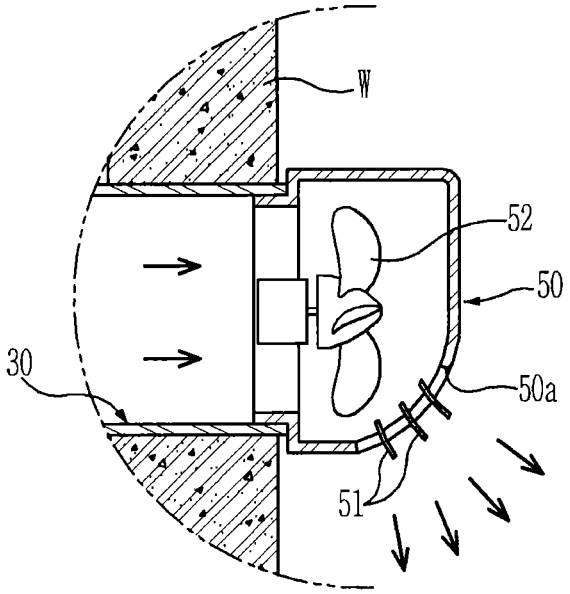
FIG. 6 is a sectional view illustrating an indoor unit applied to the air conditioner in accordance with another embodiment of the present invention.

Also, although only the guide member 41 is installed at the indoor unit 40 in the illustrated embodiment, embodiments of the present invention are not limited thereto. As shown in FIG. 6, an auxiliary blowing fan 52 may be installed in the indoor unit 50 in order to increase the discharge rate of cold air discharged through the indoor outlet 50*a*. Guide member 51 may also be installed at the indoor outlet 50*a*, similar to the configuration illustrated in FIG. 4.

Figure 7:
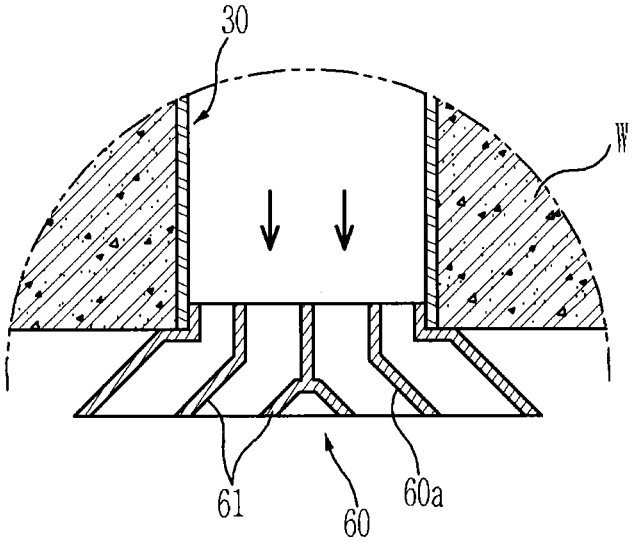
FIG. 7 is a sectional view illustrating an indoor unit applied to the air conditioner in accordance with another embodiment of the present invention.
Figure 8:
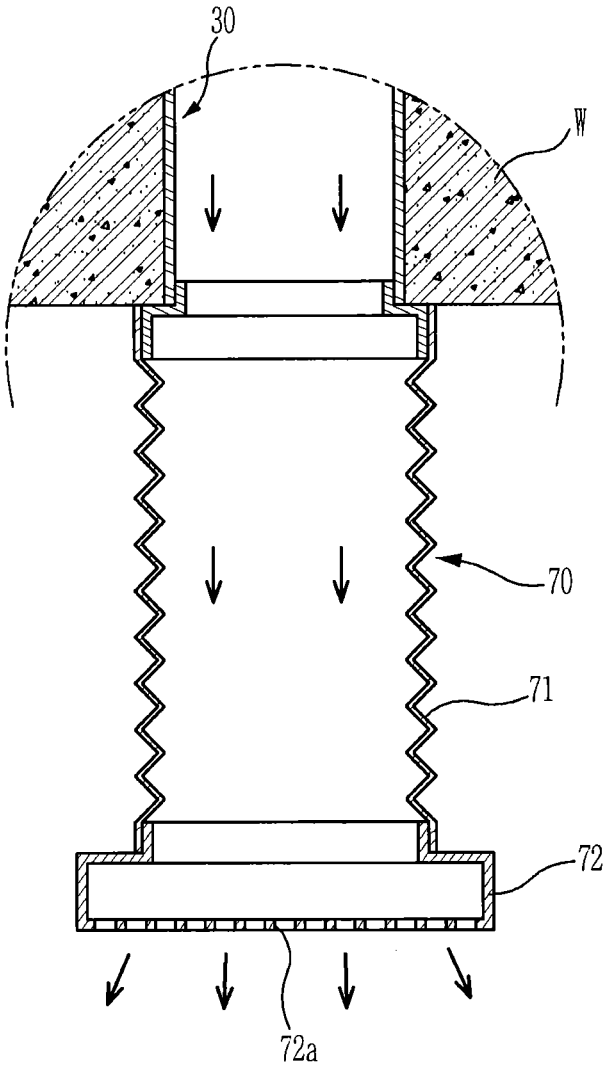
FIG. 8 is a sectional view illustrating an indoor unit applied to the air conditioner in accordance with another embodiment of the present invention.

The indoor unit may be arranged or modified to accommodate a variety of configurations according to the circumstance and skill of those skilled in the art. In one embodiment, the wall in which discharge guide tube 30 and indoor unit 40 are disposed may be different from a wall in which suction guide tube 20 is disposed. For example, FIG. 7 illustrates an indoor unit 60 installed at a ceiling or roof of a building. In this instance, suction guide tube 20 may be disposed in a side wall. The indoor unit 60 includes a plurality of guide members 61 having a quadrangular pyramid shape to distribute air discharged through the indoor outlet 60*a* in all directions. Also, FIG. 8 illustrates an indoor unit 70 including a bellows tube 71 connected to the other end of the discharge guide tube 30, and a head 72 mounted to a free end of the bellows tube 71 and provided with a plurality of indoor outlets 72*a*.

Although the first outlet 10*b* is formed at the top wall of the body 10 in the illustrated embodiment, embodiments of the present invention are not limited thereto. The first outlet 10*b* may be formed at a side wall or rear wall of the body 10. Also, although the second inlet 10*c* is formed at the upper portion of the front wall of the body 10 in the illustrated embodiment, embodiments of the present invention are not limited thereto. The second inlet 10*c* may be formed at a lower portion of the front wall of the body 10 or a side wall of the body 10.

In another embodiment, the body 10 shown in FIG. 1 may be extended in a vertical direction from the evaporator and the auxiliary blowing fan 52 of FIG. 6 may instead be disposed in this extended portion to increase the discharge rate of the cold air. For example, the auxiliary blowing fan 52 may be disposed in a vertical plane as in FIG. 6, and discharge guide tube 30 may be formed at a side wall of the body 10. Alternatively, the auxiliary blowing fan may be disposed in a horizontal plane, above and in parallel with the evaporator, and the discharge guide tube 30 may be disposed above the auxiliary blowing fan.

As can be seen from FIG. 1 and FIG. 5, a support structure S may be provided to support the body 10. However, support structure S is not necessary and instead body 10 may be directly attached or mounted to wall W, or may be supported in another manner, if needed.

As apparent from the above description, it may be possible to configure the body such that it has a slim structure because the evaporator is disposed at a higher level than the condenser, as described above. Also, it may be possible to transfer condensed water generated from the evaporator to the condenser by gravity.

Although a few example embodiments of the present invention have been shown and described, it would be appreciated by those skilled in the art that changes may be made to these embodiments without departing from the principles and spirit of the invention, the scope of which is defined in the claims and their equivalents.

What is claimed is:

1. An air conditioner comprising:

a body installed at an outdoor space;

an air discharge tube to guide cold air discharged from the body to an indoor space;

a compressor to compress a refrigerant;

a condenser to cool the refrigerant discharged from the compressor such that the refrigerant is condensed;

an expansion device to expand the condensed refrigerant through pressure reduction;

an evaporator to cause the refrigerant emerging from the expansion device to be evaporated while absorbing heat; and a condensed water tray disposed beneath the evaporator, to collect condensed water falling from the evaporator and to transfer the condensed water generated from the evaporator to the condenser to cool the condenser, wherein the compressor, the condenser, the expansion device, and the evaporator are installed in the body, and wherein the evaporator is disposed in an upper portion of the body at a higher level than the condenser.

2. The air conditioner according to claim 1, further comprising:

a water distribution tray disposed over the condenser, and provided with a plurality of water outlets to supply the condensed water to the condenser in a distributed manner; and a water guide tube to guide the condensed water collected in the condensed water tray to the water distribution tray.

3. The air conditioner according to claim 1, wherein the condensed water tray is disposed at a side of the evaporator to avoid blocking air flowing toward the evaporator.

4. The air conditioner according to claim 3, wherein the evaporator is inclined toward the condensed water tray so that the condensed water generated by the evaporator is collected into the condensed water tray.

5. The air conditioner according to claim 1, wherein the condensed water tray is inclined toward the water distribution tray.

6. An air conditioner comprising:

a body installed at an outdoor space;

an air discharge tube to guide cold air discharged from the body to an indoor space;

a compressor to compress a refrigerant;

a condenser to cool the refrigerant discharged from the compressor such that the refrigerant is condensed;

an expansion device to expand the condensed refrigerant through pressure reduction; and an evaporator to cause the refrigerant emerging from the expansion device to be evaporated while absorbing heat, wherein the compressor, the condenser, the expansion device, and the evaporator are installed in the body, and wherein the evaporator is disposed in an upper portion of the body at a higher level than the condenser, wherein the body further comprises:

a first inlet to suck in air to exchange heat with the evaporator, and a first outlet to discharge air after the air exchanges heat with the evaporator; and a second inlet to suck in air to exchange heat with the condenser, and a second outlet to discharge air to exchange heat with the condenser, wherein, a first end of the air discharge tube is connected to the first outlet.

7. The air conditioner according to claim 6, wherein the body further comprises a separation wall which separates air which exchanges heat with the evaporator from air which exchanges heat with the condenser, wherein the separation wall is curved in a direction toward the second inlet to guide the air sucked in through the first inlet to spread across a bottom surface of the evaporator.

8. The air conditioner according to claim 6, wherein:

the air sucked into the body through the first inlet is transferred to the first outlet after vertically passing through the body; and the air sucked into the body through the second inlet is transferred to the second outlet after vertically passing through the body.

9. The air conditioner according to claim 8, wherein the air sucked into the body through the first inlet and the air sucked into the body through the second inlet pass through the body in opposite vertical directions, respectively.

10. The air conditioner according to claim 1, further comprising:

an air suction tube having a first end connected to a first inlet of the body, to guide air from the indoor space to the body.

11. The air conditioner according to claim 6, wherein a second end of the air discharge tube is connected to a second through hole of a wall separating the indoor space and outdoor space, and a second end of the air suction tube is connected to a first through hole of a wall separating the indoor space and outdoor space.

12. An air conditioner comprising:

a body installed at an outdoor space;

an air discharge tube to guide cold air discharged from the body to an indoor space;

a compressor to compress a refrigerant;

a condenser to cool the refrigerant discharged from the compressor such that the refrigerant is condensed;

an expansion device to expand the condensed refrigerant through pressure reduction;

an evaporator to cause the refrigerant emerging from the expansion device to be evaporated while absorbing heat;

a first blowing fan installed in the body, to cause air to exchange heat with the condenser; and a second blowing fan installed in the body, to cause air to exchange heat with the evaporator, wherein the compressor, the condenser, the expansion device, and the evaporator are installed in the body, and wherein the evaporator is disposed in an upper portion of the body at a higher level than the condenser.

13. The air conditioner according to claim 12, further comprising:

a drive motor installed in the body, to generate a rotating force, wherein the first blowing fan is mounted to one end of a rotating shaft of the drive motor, and the second blowing fan is mounted to the other end of the rotating shaft of the drive motor.

14. The air conditioner according to claim 6, wherein the first outlet is provided at a top wall of the body, and the evaporator is disposed in a position corresponding to the first outlet.

15. The air conditioner according to claim 14, wherein:

the body is disposed to face, at a rear wall thereof, a wall of a building;

the second inlet and the second outlet are vertically arranged and located at a front wall of the body; and the condenser is disposed in a front portion of the body corresponding to the location of the second outlet.

16. The air conditioner according to claim 1, further comprising:

an indoor unit disposed in the indoor space, and connected to the air discharge tube, wherein the indoor unit comprises an indoor outlet to discharge cold air into the indoor space.

17. The air conditioner according to claim 16, further comprising:

a guide member installed at the indoor outlet, to guide a flow direction of the cold air discharged through the indoor outlet.

18. The air conditioner according to claim 17, wherein the guide member is pivotably installed to change the flow direction of the cold air discharged through the indoor outlet.

19. The air conditioner according to claim 16, wherein the indoor unit further comprises an auxiliary blowing fan to increase a flow rate of the cold air discharged through the indoor outlet.

20. An air conditioner comprising:

a body disposed in an outdoor space;

a condenser disposed in the body, to cause a refrigerant to be cooled while exchanging heat with outdoor air;

an evaporator disposed in an upper portion of the body above the condenser, to cause the refrigerant to evaporate while absorbing heat, and to cause condensed water generated at a surface of the evaporator to be transferred to the condenser by gravity;

an air discharge tube to guide, to an indoor space, cold air discharged from the body after passing through the evaporator; and a condensed water tray disposed beneath the evaporator, to collect condensed water falling from the evaporator and to transfer the condensed water generated from the evaporator to the condenser to cool the condenser.

21. The air conditioner according to claim 20, further comprising:

a water distribution tray disposed over the condenser, and provided with a plurality of water outlets to supply the condensed water to the condenser in a distributed manner; and a water guide tube to guide the condensed water collected in the condensed water tray to the water distribution tray.

22. The air conditioner according to claim 20, further comprising:

an air suction tube to guide air from the outdoor space or from the indoor space to the body.

23. An air conditioner comprising:

a body disposed in an outdoor space;

a condenser disposed in the body, to cause a refrigerant to be cooled while exchanging heat with outdoor air;

an evaporator disposed in an upper portion of the body above the condenser, to cause the refrigerant to evaporate while absorbing heat, and to cause condensed water generated at a surface of the evaporator to be transferred to the condenser by gravity;

an air discharge tube to guide, to an indoor space, cold air discharged from the body after passing through the evaporator;

a compressor to compress the refrigerant, wherein the condenser cools the refrigerant discharged from the compressor to condense the refrigerant; and an expansion device to expand the condensed refrigerant through pressure reduction, wherein the evaporator causes refrigerant emerging from the expansion device to be evaporated while absorbing heat, and the compressor, the condenser, the expansion device, and the evaporator are entirely disposed within the body.

24. The air conditioner according to claim 20, further comprising:

an indoor unit disposed in the indoor space, and connected to the air discharge guide tube, wherein the indoor unit comprises an indoor outlet to discharge cold air into the indoor space.

25. An air conditioner comprising:

a body entirely disposed within a space exterior to a building, wherein the body includes:

a condenser disposed in a lower portion of the body, an evaporator disposed above the condenser in an upper portion of the body, a first fan disposed below the evaporator to draw air external to the body into the body and to direct air circulating within the body toward the evaporator, a second fan to direct air circulating within the body toward the condenser, and a first inlet to draw in air external to the body and a first outlet to discharge air which has passed through the evaporator, out of the body.

26. The air conditioner according to claim 25, wherein the body further includes:

a compressor;

an expansion device to transfer refrigerant between the condenser and the evaporator; and a drive motor to generate a rotating force to the first fan and second fan.

27. The air conditioner according to claim 26, further comprising:

an air discharge tube having a first end connected to the first outlet to receive cold air discharged from the body after passing through the evaporator and a second end through which the cold air is discharged to an interior space within the building; and an air suction tube disposed adjacent to the first fan and having a first end connected to the first inlet and a second end through which air external to the body is drawn into by a rotation force of the first fan.

28. The air conditioner according to claim 27, wherein the second end of the air discharge tube is connected to an indoor unit disposed in the interior space, wherein the indoor unit comprises an indoor outlet to discharge cold air into the interior space, and the indoor unit includes:

a bellows tube having a first end connected to the air discharge tube and a head mounted to a second end of the bellows tube, or a plurality of guide members having a quadrangular pyramid shape to distribute air in a plurality of directions.

29. The air conditioner according to claim 25, wherein the evaporator is longitudinally disposed in a direction which is substantially perpendicular to a longitudinal direction of the condenser.

30. The air conditioner according to claim 25, wherein the first fan and the second fan are mounted on a same rotating shaft.

* * * * *

UNITED STATES PATENT AND TRADEMARK OFFICE

CERTIFICATE OF CORRECTION

PATENT NO. : 9,151,507 B2
APPLICATION NO. : 13/666312
DATED : October 6, 2015
INVENTOR(S) : Yong Hyun Kil et al.

It is certified that error appears in the above-identified patent and that said Letters Patent is hereby corrected as shown below:

On the title page

Item 74, Column 2 (Attorney, Agent, or Firm), Line 1
Delete "Stass" and insert -- Staas --, therefor.

Item 57, Column 2 (Abstract), Line 5
Delete "it" and insert -- it is --, therefor.

In the claims

Claim 24, Column 12, Line 42
Delete "discharge guide" and insert -- discharge --, therefor.

Signed and Sealed this
Fifth Day of April, 2016

Michelle K. Lee

Michelle K. Lee
*Director of the United States Patent and Trademark Office*